US006309511B1

(12) United States Patent
Iwata et al.

(10) Patent No.: US 6,309,511 B1
(45) **Date of Patent: *Oct. 30, 2001**

(54) DEWATERING INSTRUMENT FOR A PAPER MACHINE TWIN-WIRE FORMER

(75) Inventors: Hiroshi Iwata; Kazuhiko Masuda, both of Hiroshima-ken (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/049,105

(22) Filed: Mar. 27, 1998

(30) Foreign Application Priority Data

Apr. 15, 1997 (JP) ..... 9-097219

(51) Int. Cl.[7] ..... D21F 1/54
(52) U.S. Cl. ..... 162/352; 162/351; 162/301
(58) Field of Search ..... 162/352, 354, 162/374, 363, 351, 300–301, 289

(56) References Cited

U.S. PATENT DOCUMENTS

| | | | | |
|---|---|---|---|---|
| 4,999,087 | * | 3/1991 | Ebihara et al. | 162/301 |
| 5,061,347 | * | 10/1991 | Bubik et al. | 162/301 |
| 5,147,508 | * | 9/1992 | Sweet | 162/279 |
| 5,248,392 | * | 9/1993 | Bando et al. | 162/301 |

FOREIGN PATENT DOCUMENTS

| | | |
|---|---|---|
| 0 369 296 | 5/1990 | (EP) . |
| 0 471 469 | 2/1992 | (EP) . |
| 4-507439 | 12/1992 | (JP) . |
| 8-325973 | 12/1996 | (JP) . |

* cited by examiner

*Primary Examiner*—Jose Fortuna
(74) *Attorney, Agent, or Firm*—Armstrong, Westerman, Hattori, McLeland & Naughton, LLP

(57) ABSTRACT

A dewatering instrument for a paper machine twin-wire former for improving the fiber dispersion performance while avoiding the decrease in strength of formed paper in its thickness directions. In the dewatering instrument, dewatering inhibiting blades have plane sections for supporting a wire and inclined surfaces for defining wedge-shaped spaces spreading out toward the upstream side in the wire traveling direction with respect to a wire plane formed on a wire entry side of the plane sections. Angles (wedge-angles) between the inclined surfaces and the wire are set to become sequentially smaller as a whole in proportion as the dewatering inhibiting blades are positioned on the further downstream side in the flowing direction of a paper raw material liquid. Or, the dimensions of the wedge-shaped spaces defined between the inclined surfaces and the wires are made to become sequentially larger as a whole in proportion as the dewatering inhibiting blades are positioned on a further downstream side in the flowing direction of a paper raw material liquid. With the configurations of the dewatering inhibiting blades, the dewatering pressure peak value increases in accordance with advancing toward the downstream.

24 Claims, 6 Drawing Sheets

DEWATERING INSTRUMENT FOR A PAPER MACHINE TWIN-WIRE FORMER

BACKGROUND OF THE INVENTION

1. Field of the Invention

The present invention relates to a dewatering instrument for a paper machine twin-wire former, which is of a type of conducting a dewatering operation through the use of a dewatering inhibiting blade.

2. Description of the Related Art

So far, a twin-wire former has been known as a paper layer forming apparatus for a paper machine. This twin-wire former includes two wires each shaped into a loop configuration, where the moisture is removed from a paper raw material liquid by various dewatering instruments while the paper raw material liquid travels in a state of being put between the two wires, thereby gradually forming a fiber mat which in turn, develops into a web.

FIG. 5 illustratively shows a structure of one example of twin-wire former, and referring to this figure, a description will be made hereinbelow of a paper layer forming apparatus for the twin-wire former.

As shown in FIG. 5, a paper raw material liquid 2 is accommodated within a head box 1, and the paper raw material liquid 2 is spouted out from the interior of the head box 1 toward a gap (paper gap) 15 (see FIGS. 6 and 7) defined by the upper and lower wires 3, 4.

The upper wire (top wire) 3 is guided by a forming roll 11 and guide rolls 3A to 13E, while the lower wire (bottom wire) 4 is guided by a breast roll 12, guide rolls 14A to 14D and others, with the gap 15 being defined between these upper and lower wires 3, 4. The paper raw material liquid 2 develops into a paper layer while traveling within the gap 15.

More specifically, the upper and lower wires 3, 4 rotate to shift in a given direction (in FIG. 5, in the right-hand direction), and the paper raw material liquid 2 moves within the gap 15 at a speed substantially equal to that of the wires 3, 4. The gap 15 is gradually reduced toward the downstream side in the traveling direction, and the loop of each of the wires 3, 4 on the upstream side of the gap 15 is shaped into a curved configuration whose radius of curvature is R. On the upstream side of the gap 15, there are provided a first dewatering instrument 5, a second dewatering instrument 6 and a third dewatering instrument 7 arranged in order. Further, on the downstream side of these first to third dewatering instruments 5 to 7, located are a suction couch roll 8 and a transfer box 9.

The first dewatering instrument 5 is placed within the bottom wire 4 loop with a radius of curvature of R. As shown in FIG. 6, in the first dewatering instrument 5, a plurality of dewatering blades 20 are respectively connected to fitting sections 30A of a base 30 in a state of being spaced from each other, and while the paper raw material liquid 2 travels along the gap 15 with a curved configuration approximate to the radius of curvature assuming R, owing to the dewatering pressure occurring by the crimps or bending of the top wire 3 and the bottom wire 4 on the respective dewatering blades 20, the dewatering takes place toward both the sides (the upper and lower wires 3, 4 sides) (see arrows indicated with the terms "white water"), thus gradually developing into a fiber mat within the gap 15.

Furthermore, the second dewatering instrument 6 is located within the loop of the top wire 3 with the radius of curvature of R, and is, as shown in FIG. 7, equipped with a plurality of dewatering inhibiting blades 21 on fitting sections 33 of a base 31, and an inclined surface 24 and a plane section 23 are formed on the wire side in each of the dewatering inhibiting blades 21. The plane section 23 comes into contact with the top wire 3 to support it. An inclined surface 24 is located on the upstream side of the plane section 23 in the wire traveling direction, and is disposed to gradually separate from the top wire 3 toward the upstream side in the wire traveling direction.

In addition, a wedge-shaped space 25 is defined between each of the inclined surface 24 and the top wire 3. The inclination angle θ of the inclined surface 24 is referred to as a wedge-angle. In this second dewatering instrument 6, the dewatering toward the top wire 3 side is suppressed by the dewatering inhibiting blades 21 while the dewatering is allowed to only the bottom wire 4 side, thereby gradually forming a web.

The third dewatering instrument 7 is called a suction box, and is positioned within the loop of the bottom wire 4. The dewatering based upon vacuum is made in this third dewatering, instrument 7 and the suction couch roll 8, and a web produced through the transfer box 9 is surely delivered onto the bottom wire 4 and then transferred through a non-shown suction pickup roll to the next press part.

Meanwhile, in the case of using the prior dewatering inhibiting blades 21 (see FIG. 7) as a dewatering instrument, since the dewatering inhibiting blades 21 have the same configurations, as shown in FIG. 8, the dewatering pressures occurring between the two wires 3, 4 substantially assume the same level throughout the entire forming position (position in the direction of flow of the paper raw material liquid). FIG. 8 shows measured data, and although the dewatering pressure level slightly varies due to the fitting accuracy of the dewatering blades, it is considered that such a difference substantially makes the same level.

In accordance with the peak value of the dewatering pressure, a shear force takes place due to a relative speed difference in the wire or the paper raw material liquid between the fiber mat layers, and this shear force takes action to uniformly disperse the fibers.

However, since the paper raw material liquid is dewatered as it goes toward the further downstream side in the flow direction, the fiber concentration increases and the mobility (the easiness of movement of the fibers) deteriorates, so that a serious problem arises in that the dispersion performance or ability of the fibers decreases if the same shear force is applied thereto.

As a countermeasure against this problem, there may be taken a technique in which, as shown in FIG. 9, the dewatering inhibiting blades 21 are disposed intermittently and the dewatering blades 22 are disposed at a position being in an opposed relation through the wires 3, 4 to the dewatering inhibiting blades 21 to be movable toward the bottom wire 4 to adjust the pressing forces by the dewatering blades 22 so that the dewatering pressure peak value is adjustable.

That is, a fitting member 34 for the dewatering blade 22 is disposed to be movable with respect to the base 32, and an air-pressure giving member 35 is put between the fitting member 34 and the base 32 to bias the fitting member 34 and the dewatering blade 22 toward the bottom wire 4 side by the air pressure. Through this air-pressure adjustment, the dewatering pressure peak value is adjustable to maintain the fiber dispersion performance.

There is a problem which arises with such a means, however, in that, although the fiber dispersion is improvable, since the dewatering of the paper raw material is made from both the top wire 3 side and the bottom wire 4 side, the short fibers at the central portion in the direction of the thickness of the paper layer move toward the external layer sections to decrease in the intermediate layer section, and therefore, the inter-fiber coupling strength in the intermediate layer section becomes weak to cause the strength of the formed paper in its thickness directions to decrease.

SUMMARY OF THE INVENTION

The present invention has been developed in order to eliminate the above-mentioned problem, and it is therefore an object of this invention to provide a dewatering instrument for a paper machine twin-wire former which is capable of enhancing the fiber dispersion performance concurrently with preventing the decrease in the thickness-direction strength of the formed paper.

For this purpose, in accordance with the present invention, a dewatering instrument for a paper machine twin-wire former which is equipped with a plurality of dewatering inhibiting blades disposed to face a paper gap defined between two wires each having a loop configuration and which is made to operate the wires in a state where a paper raw material liquid is placed within the paper gap to transfer the paper raw material liquid while dewatering the paper raw material liquid, wherein each of the dewatering inhibiting blades has a plane section for supporting the wires and an inclined surface forming a wedge-shaped space spreading out toward an upstream side in the wire traveling direction with respect to a wire plane formed on a wire entry side of the plane section, and the configurations of the dewatering inhibiting blades are set on the basis of the relationship between a dewatering pressure peak value characteristic and the configurations of the dewatering inhibiting blades to provide a characteristic whereby a dewatering pressure peak value increases in accordance with advancing toward a downstream side in a flowing direction of the paper raw material liquid.

With this structure, since the dewatering pressure peak value increases in accordance with the advance to the downstream side due to the configuration characteristic of the dewatering inhibiting blades, the fiber dispersion performance further deteriorate due to the impairment of the mobility (easiness of movement of the fibers) caused by the rise in the fiber concentration as the paper raw material liquid proceeds to the downstream side in its flowing direction, whereas the increase in the dewatering pressure peak value can improve the fiber dispersion performance, which allows the dewatering while maintaining the dispersion performance.

In addition, owing to the dewatering inhibiting effects of the dewatering inhibiting blades, the dewatering is principally made from one wire side, that is, the dewatering is made asymmetrically, and therefore, the weakest cross-section portion formed in the intermediate section at the central section in the thickness direction of the paper layer in the prior art can be shifted toward the paper surface side (the front or rear surface side), so that the suppression of lowering the strength in the paper thickness direction and the improvement of the fiber dispersion are compatible with each other.

Furthermore, preferably, the angles made between the inclined surfaces and the wire are set to become sequentially smaller as a whole in proportion as the corresponding dewatering inhibiting blades are positioned on a further downstream side in the flowing direction of the paper raw material liquid (that is, the angle of the dewatering inhibiting blade on the further downstream side in the paper raw material liquid flowing direction is set to be smaller than that of the previous dewatering inhibiting blade).

Since the angles (wedge angles) between the inclined surfaces of the dewatering inhibiting blades and the wire are set to become sequentially smaller in proportion as the dewatering inhibiting blades are positioned on the further downstream side in the flowing direction of the paper raw material liquid, the dewatering pressure peak value increases toward the downstream side.

In consequence, the above-mentioned effect occurs, that is, although the increase in the fiber concentration taking place toward the downstream side in the flowing direction deteriorates the mobility (the easiness of movement of the fibers) to lower the fiber dispersion performance, the increase in the dewatering pressure peak value enhances the fiber dispersion performance, which allows the dewatering concurrently with maintaining the dispersion performance, and since the dewatering is made asymmetrically, the weakest cross-section portion formed in the intermediate section at the central section in the thickness direction of the paper layer can be shifted toward the paper surface side, so that the suppression of lowering the strength in the paper thickness direction and the improvement of the fiber dispersion are compatible with each other.

Still further, preferably, the dimensions of the wedge-shaped spaces defined between the inclined surfaces and the wire is made to become sequentially larger as a whole in proportion as the dewatering inhibiting blades are positioned on a further downstream side in the flowing direction of the raw material liquid (that is, the dimension of the wedge-shaped space for the dewatering inhibiting blade on the further downstream side in the paper raw material liquid flowing direction is set to be larger than that for the preceding dewatering inhibiting blade).

Since the dimensions of the wedge-shaped spaces defined between the inclined surfaces and the wire are made to become sequentially larger as a whole in accordance with advancing toward the flowing direction of the paper raw material liquid, the dewatering pressure peak value increases toward the further downstream side.

As a result, the above-mentioned effect occurs, that is, although the increase in the fiber concentration taking place toward the downstream side in the flowing direction deteriorates the mobility (the easiness of movement of the fibers) to lower the fiber dispersion performance, the increase in the dewatering pressure peak value enhances the fiber dispersion performance, which allows the dewatering concurrently with maintaining the dispersion performance, and since the dewatering is made asymmetrically, the weakest cross-section portion formed in the intermediate section at the central section in the thickness direction of the paper layer can be shifted toward the paper surface side, so that the suppression of lowering the strength in the paper thickness direction and the improvement of the fiber dispersion are compatible with each other.

Moreover, preferably, the angles made between the inclined surfaces and the wire are set to become sequentially smaller as a whole in proportion as the dewatering inhibiting blades are positioned on the further downstream side in the flowing direction of the paper raw material liquid, while the dimensions of the wedge-shaped spaces formed between the inclined surfaces and the wire are made to become sequentially larger as a whole in proportion as the dewatering inhibiting blades are positioned on the further downstream side in the flowing direction of the raw material liquid.

Since the angles made between the inclined surfaces and the wire are set to become sequentially smaller as a whole in proportion as the dewatering inhibiting blades are positioned on the further downstream side in the flowing direction of the paper raw material liquid, the dewatering pressure peak value increases toward the further downstream side, and since the dimensions of the wedge-shaped spaces formed between the inclined surfaces and the wire are made to become sequentially larger in accordance with advancing in the flowing direction of the raw material liquid, the dewatering pressure peak value increases toward the further downstream side.

Accordingly, the above-mentioned effect occurs, that is, although the increase in the fiber concentration taking place toward the downstream side in the flowing direction deteriorates the mobility (the easiness of movement of the fibers) to lower the fiber dispersion performance, the increase in the dewatering pressure peak value enhances the fiber dispersion performance, which allows the dewatering concurrently with maintaining the dispersion performance, and since the dewatering is made asymmetrically, the weakest cross-section portion formed in the intermediate section at the central section in the thickness direction of the paper layer can be shifted toward the paper surface side, so that the suppression of lowering the strength in the paper thickness direction and the improvement of the fiber dispersion are compatible with each other.

Besides, it is also appropriate that the plurality of dewatering inhibiting blades are disposed intermittently.

If the dewatering inhibiting blades are disposed intermittently, the fiber dispersion is improvable. In the case of attaching importance to the fiber dispersion, this structure is effective.

Furthermore, it is also possible that the plurality of dewatering inhibiting blades are disposed in succession.

If the dewatering inhibiting blades are placed sequentially, the fiber dispersion and the thickness-direction strength are compatible with each other.

Furthermore, preferably, a portion of or all of the plurality of dewatering inhibiting blades are constructed to be insertable or extractable in their width directions.

Thus, through the insertion/extraction of a portion of or all of the dewatering inhibiting blades, they are replaced with dewatering inhibiting blades with an appropriate wedge angle θ, so that the dewatering quantity distribution or the dewatering ability is easily adjustable in accordance with the kind of paper or the paper-producing conditions.

Still further, preferably, the two wires are a top wire and a bottom wire, respectively, and the plurality of dewatering inhibiting blades are placed within the loop of the top wire.

DESCRIPTION OF THE PREFERRED EMBODIMENTS

Figure 1:
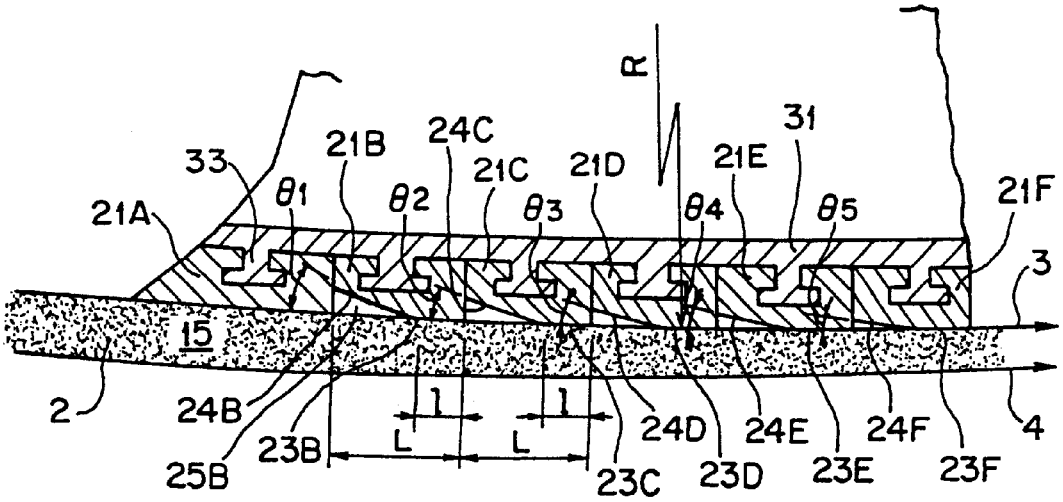
FIG. 1 is a cross-sectional view illustratively showing a dewatering instrument for a paper machine twin-wire former according to a first embodiment of the present invention.
Figure 2:
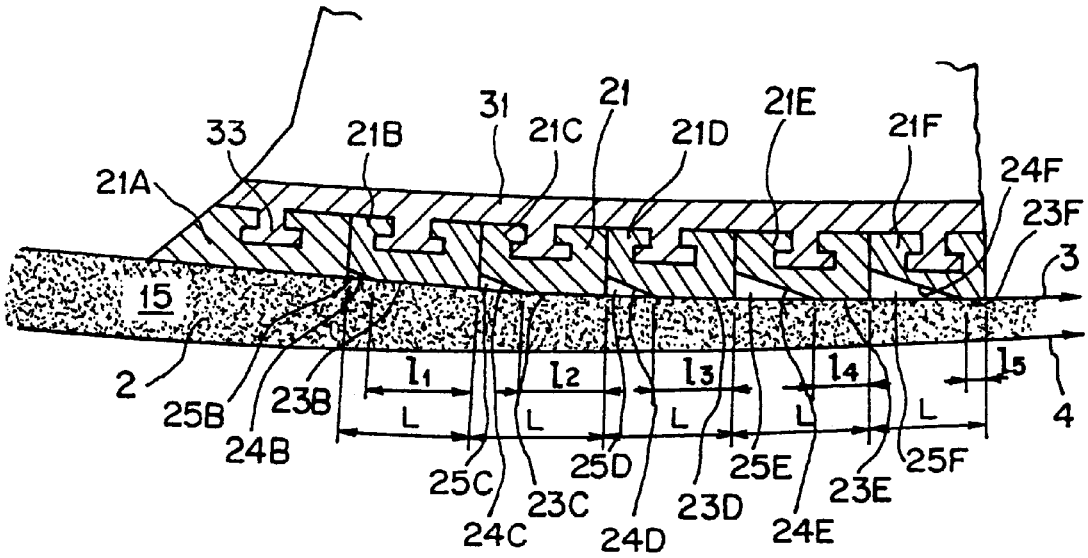
FIG. 2 is a cross-sectional view illustratively showing a dewatering instrument for a paper machine twin-wire former according to a second embodiment of the present invention.
Figure 3:
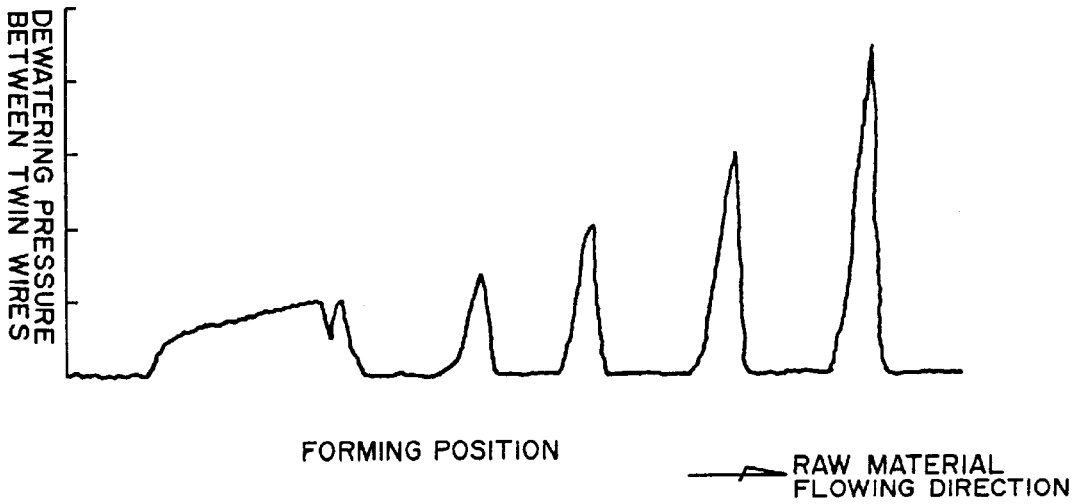
FIG. 3 is an illustration of a dewatering pressure characteristic of the dewatering instruments according to the embodiments of this invention.
Figure 4:
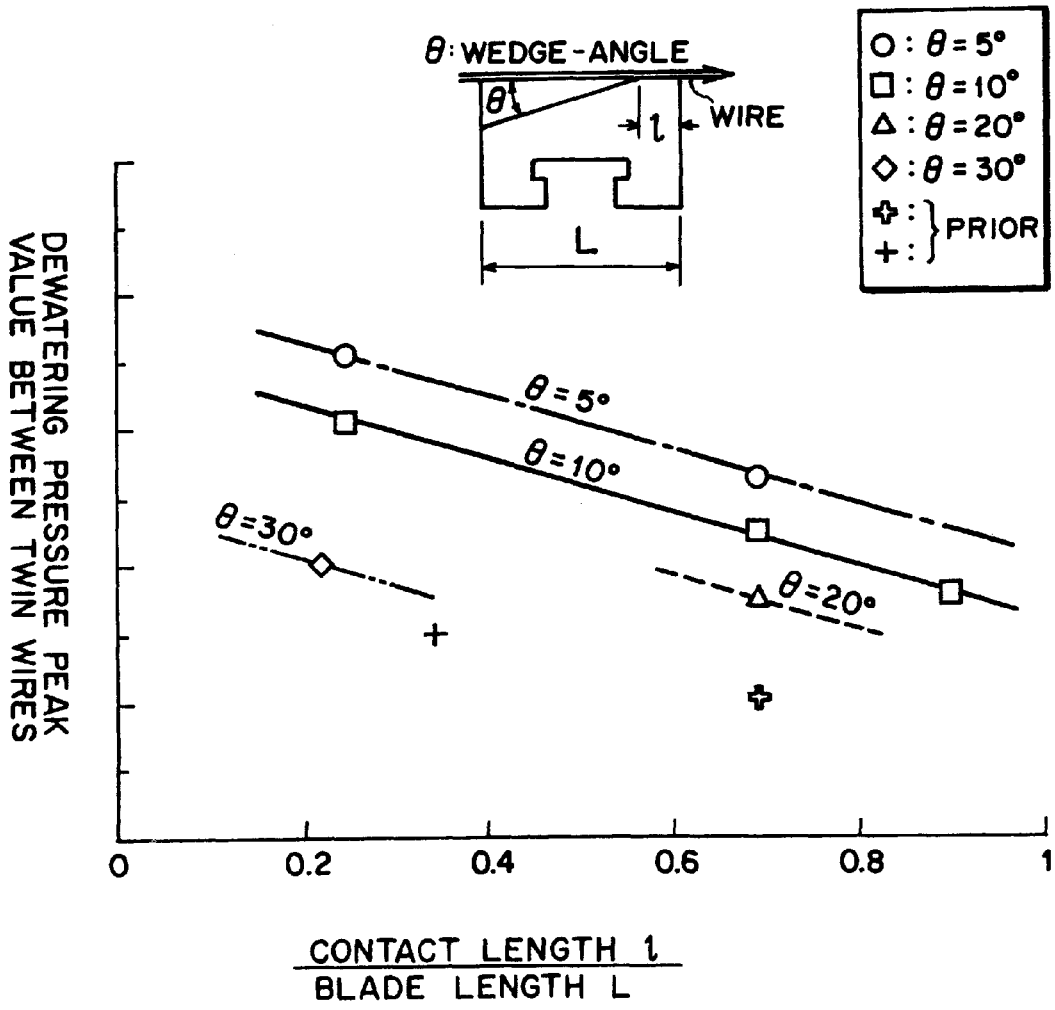
FIG. 4 is an illustration of a variation characteristic of a dewatering pressure peak in relation to the setting of dewatering inhibiting blades of the dewatering instrument.

Embodiments of the present invention will be described hereinbelow with reference to the drawings. FIG. 1 shows a dewatering instrument for a paper machine twin-wire former according to a first embodiment of the present invention, FIG. 2 illustrates a dewatering instrument for a paper machine twin-wire former according to a second embodiment of the present invention, FIG. 3 is an illustration of an example of variations of a dewatering pressure in the embodiments of this invention, and FIG. 4 is an illustration of a characteristic of a dewatering pressure peak in the embodiments. The description will be made referring to these figures.

First, a description will be taken hereinbelow of a first embodiment. A paper machine twin-wire former including this dewatering instrument has a construction shown in FIG. 5 as already mentioned as the prior technique.

Figure 5:
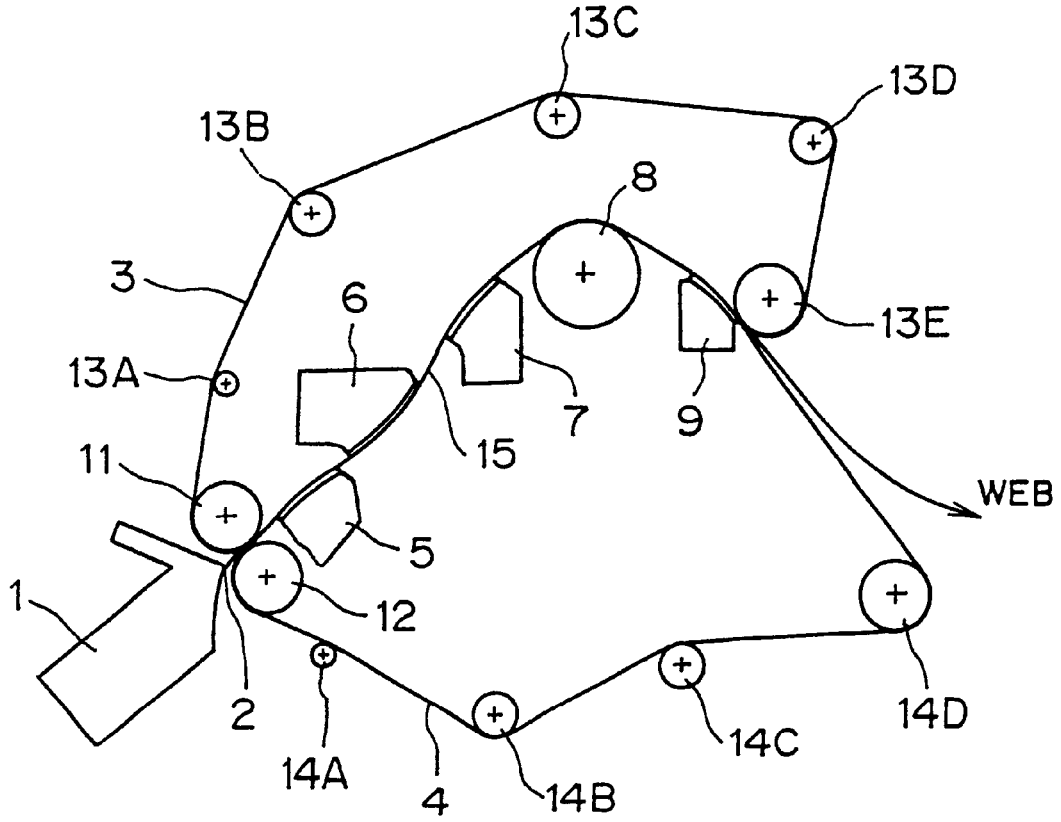
FIG. 5 illustratively shows a construction of one example of paper machine twin-wire formers.

More specifically, as shown in FIG. 5, the paper machine twin-wire former is equipped with a head box 1, a top wire 3 and a bottom wire 4, and each of the top wire 3 and the bottom wire 4 has a loop configuration and a gap (paper gap) 15 is defined between the top wire 3 and the bottom wire 4, with a paper raw material liquid 2 accommodated within the head box 1 being spouted out from the head box 1 toward the paper gap 15.

The top wire 3 is guided by a forming roll 11 and guide rolls 13A to 13E, while the bottom wire 4 is guided by a breast roll 12, guide rolls 14A to 14D and others. These rolls are rotationally driven to send the paper raw material liquid 2 within the gap 15 in a given direction (in FIG. 5, in the right-hand direction). The paper raw material liquid 2 spouted out from the head box 1 to the gap 15 is accommodated within the gap 15 to travel therein at a speed substantially equal to that of the wires 3, 4, thereby being dewatered to form a paper layer.

The gap 15 is gradually reduced toward the downstream side in the traveling direction, and the loop of each of the wires 3, 4 on the upstream side of the gap 15 is shaped into a curved configuration whose radius of curvature is R. On the upstream side of the gap 15, there are provided a first dewatering instrument 5, a second dewatering instrument 6, a third dewatering instrument 7, a suction couch roll 8 and a transfer box 9 arranged in order, which perform the dewatering of the paper raw material liquid 2 and the formation of a paper layer.

Subsequent to the dewatering in the first dewatering instrument 5 and the second dewatering instrument 6, the dewatering based upon vacuum is conducted in the third dewatering instrument 7, which is also referred to as a suction box and located within the loop of the bottom wire 4, and the suction couch roll 8. The formed web is carried through the transfer box 9 onto the bottom wire 4 and then transferred through a non-shown suction pickup roll to the next press part.

Figure 6:
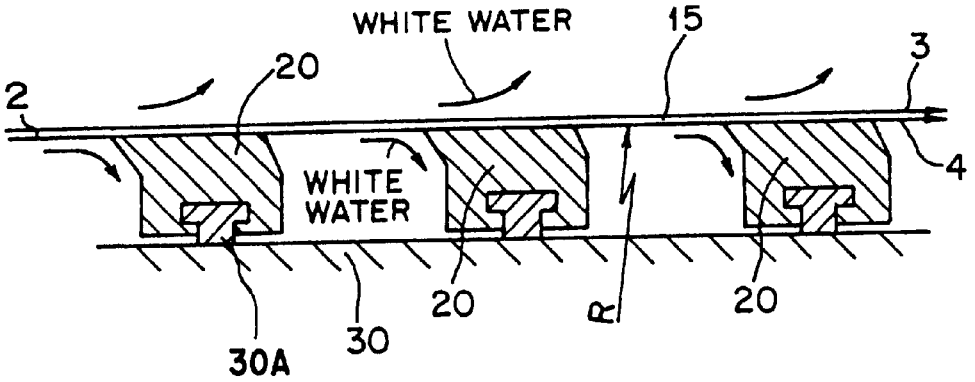
FIG. 6 PRIOR ART
FIG. 6 is a cross-sectional view illustratively showing one example of prior dewatering instruments.
Figure 7:
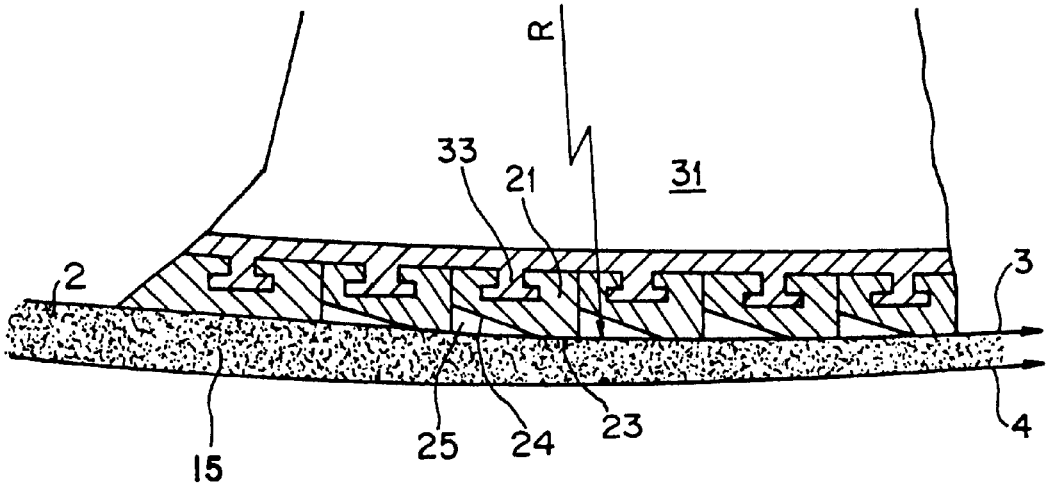
FIG. 7 PRIOR ART
FIG. 7 is a cross-sectional view illustratively showing one example of prior dewatering instruments.
Figure 8:
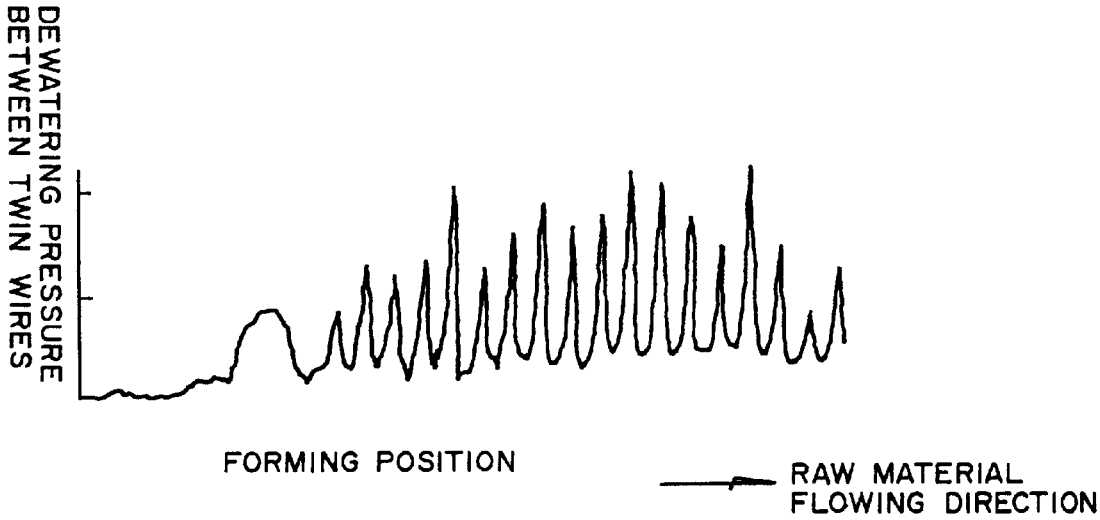
FIG. 8 RELATED ART
FIG. 8 is an illustration of a dewatering pressure characteristic of the prior dewatering instrument.

As in the case of the prior technique, the first dewatering instrument 5 is located within the curved loop (the radius of curvature is R) of the bottom wire 4, and is equipped with a plurality of dewatering blades 20 disposed at an interval and connected to fitting sections 30A of a base 30 (see FIG. 6). With this structure, while the paper raw material liquid 2 travels along the gap 15 with a curved configuration approximate to the radius of curvature assuming R, owing to the dewatering pressure occurring by the crimps or bending of the top wire 3 and the bottom wire 4 on the respective dewatering blades 20, the dewatering takes place on both the sides (the upper and lower wire 3, 4 sides) (see arrows indicated with the terms "white water"), thus gradually developing into a fiber mat within the gap 15.

The second dewatering instrument 6 constitutes a dewatering instrument according to this invention, and is located within the loop of the top wire 3 whose radius of curvature is R, and as shown in FIG. 1, is provided with a plurality of dewatering inhibiting blades 21A to 21F connected to fitting portions 33 of a base 31. Each of the dewatering inhibiting blades 21A to 21F is constructed as being insertable and extractable in the width directions (in the thickness directions of the FIG. 1 paper sheet), while the length (length in the flowing direction of the paper raw material liquid 2) of each of the dewatering inhibiting blades 21A to 21F is set to L.

Plane sections 23B to 23F and inclined surfaces 24B to 24F are formed on the wire sides of the dewatering inhibiting blades 21B to 21F, respectively. Of these sections, the plane sections 23B to 23F come into contact with the top wire 3 to support the top wire 3, while the inclined surfaces 24B to 24F are formed on the upstream side (wire entry side) of the plane sections 23B to 23F in the wire traveling direction, respectively, and are made to gradually separate from the top wire 3 toward the upstream side in the wire traveling direction.

This dewatering instrument features setting the inclination angle θ of each of the inclined surfaces 24B to 24F. The inclination angle θ of each of the inclined surfaces 24B to 24F is referred to as a wedge-angle, and wedge-shaped spaces 25B to 25F are defined between the inclined surfaces 24B to 24F and the top wire 3, respectively.

More specifically, the plurality of dewatering inhibiting blades 21B to 21F are arranged in the traveling directions of the wires 3, 4, that is, in the moving direction of the paper raw material liquid 2, while the inclination angles (wedge-angles) $\theta_1$ to $\theta_5$ of the inclined surfaces 24B to 24F of the dewatering inhibiting blades 21B to 21F are made to become sequentially smaller as a whole in proportion as the dewatering inhibiting blades 21B to 21F are positioned on the further downstream side in the flowing direction of the paper raw material liquid 2 (on the further downstream side of the wire traveling direction) (that is, $\theta_1>\theta_2>\theta_3>\theta_4>\theta_5$).

This angle setting is for the purpose of further increasing the dewatering pressure peak value in accordance with advancing toward the further downstream side in the flowing direction of the paper raw material liquid 2. That is, as indicated with a two-dot chain line (θ=30°), a broken line (θ=20°), a solid line (θ=10°) and a dashed line (θ=50°), a characteristic that the dewatering pressure peak value increases as the wedge-angle θ assumes a smaller value is obtainable, and therefore, if the wedge-angles θ are made to be sequentially smaller toward the further downstream side, a higher dewatering pressure peak value is attainable toward the further downstream side.

Since the dewatering instrument for a paper machine twin-wire former according to the first embodiment of this invention is constructed as described above, the paper raw material liquid 2 spouted out from the interior of the head box 1 travels within the paper gap 15 to be dewatered by the first dewatering instrument 5, the second dewatering instrument 6, the third dewatering instrument 7 and the suction couch roll 8 for paper formation. Further, the web thus formed is transferred through the transfer box 9 onto the bottom wire 4 and subsequently delivered to the next press part by a suction pickup roll (not shown).

In this dewatering process, in the second dewatering instrument 6, the dewatering to the top wire 3 side is inhibited or suppressed by the dewatering inhibiting blades 21B to 21F, whereas the dewatering to only the bottom wire 4 side is conducted. At this time, the characteristic on the dewatering pressure occurring between the two wires 3, 4 is that, as shown in FIG. 4, the dewatering pressure peak value increases as the wedge-angle θ assumes a smaller value. In the case of this instrument, since the wedge-angles θ of the dewatering inhibiting blades 21B to 21F are made to be gradually smaller toward the further downstream side in the paper raw material liquid 2 flowing direction (the further downstream side in the extending directions of the wires 3, 4), that is, as the concentration of the paper raw material liquid 2 between the wires 3, 4 becomes higher, the dewatering pressure peak value increases toward the further downstream side.

For instance, FIG. 3 is an illustration of dewatering pressure pulses in this dewatering instrument, and it is found from this illustration that the dewatering pressure value becomes higher as the forming position (the position in the flowing direction of the paper raw material liquid 2) advances, that is, it shifts toward the further downstream side.

On the other hand, a shear force originating from the relative speed difference takes place on the raw material liquid between the wires 3, 4 or between the fiber mat layers, and this shear force takes action to uniformly disperse the fibers, and since the raw material liquid is dewatered in accordance with advancing the downstream side in its flowing direction, the fiber concentration increases to impair the mobility (the easiness of movement of the fibers), with the result that the fiber dispersion performance lowers when applying the same shear force.

However, since the dewatering pressure peak value increases toward the further downstream side as mentioned before, the shear force to be applied to the raw material liquid becomes stronger in accordance with advancing toward the downstream side, and the shear force increases to cope with the increase in the fiber concentration causing the deterioration of the mobility, and as a result, the fiber dispersion performance does not lower irrespective of advancing toward the downstream in the raw material liquid flowing direction, which allows the dewatering concurrently with maintaining the dispersion performance.

In addition, since the dewatering to the top wire 3 side is inhibited by the dewatering inhibiting blades 21A to 21F so that the dewatering is chiefly done from only the bottom wire 4 side, the movement of the short fibers in the paper raw material liquid 2 to the outer layer sections reduces, thereby sufficiently maintaining the inter-fiber connection in the intermediate layer section at the central portion in the paper layer thickness direction to ensure the strength of the formed paper in its thickness direction.

That is, regardless of being a twin-wire former having the two upper and lower wires 3, 4, the dewatering operations on the top wire 3 side and the bottom wire 4 side are accomplished asymmetrically, and therefore, the weakest cross-section portion formed in the intermediate section at the central section in the thickness direction of the paper layer in the prior art can be shifted toward the paper surface side (the front or rear surface side), so that the suppression of lowering the strength in the paper thickness direction and the improvement of the fiber dispersion are compatible with each other.

Moreover, since each of the dewatering inhibiting blades 21A to 21F is insertable and extractable in its width direction (in the direction of the thickness of the FIG. 1 paper sheet), in a manner that they are replaced with dewatering inhibiting blades with an appropriate wedge angle θ, the dewatering quantity distribution or the dewatering ability is easily adjustable in accordance with the kind of paper or the paper-producing conditions. In addition, since the length (the length in the flowing direction of the paper raw material liquid 2) of each of the dewatering inhibiting blades 21B to 21F is L, if we prepare dewatering inhibiting blades with various wedge-angles θ, which are standardized to equally have a length of L, and appropriately selecting and using them, it is possible to cope with various kinds of paper and paper producing conditions.

Secondly, a description will be made hereinbelow of a second embodiment of this invention. A dewatering instrument according to this embodiment is also provided in a paper machine twin-wire former (see FIG. 5) similar to that in the first embodiment, and the description of the twin-wire former will be omitted for brevity.

The dewatering instrument according to this embodiment constitutes a second dewatering instrument 6, and this dewatering instrument 6 is also equipped with a plurality of dewatering inhibiting blades 21A to 21F, and inclined surfaces 24B to 24F and plane sections 23B to 23F are formed on the wire sides of the dewatering inhibiting blades 21B to 21F, respectively. Further, the dewatering inhibiting blades 21B to 21F are constructed to be insertable and extractable in their width directions (in the directions of the thickness of the FIG. 2 paper sheet), and the lengths (the lengths in the flowing direction of the paper raw material liquid 2) of the dewatering inhibiting blades 21B to 21F are equally L.

The plane sections 23B to 23F are placed into contact with the top wire 3 to bear the top wire 3 while the inclined surfaces 24B to 24F are provided on the upstream side (the wire entry side) of the plane sections 23B to 23F in the wire traveling direction, respectively, and are formed to gradually separate from the top wire 3 toward the upstream side in the wire traveling direction. Further, wedge-shaped spaces 25B to 25F are defined between the inclined surfaces 24B to 24F and the top wire 3, respectively.

In this dewatering instrument, the dimensions of the wedge-shaped spaces 25B to 25F are set to increase toward the flowing direction of the paper raw material liquid 2.

In this case, the dimensions of the wedge-shaped spaces 25B to 25F are expressed by the rates of the contact lengths 1 between the plane sections 23B to 23F of the dewatering inhibiting blades 21B to 21F and the wire 3 to the lengths (the length in the flowing direction of the paper raw material liquid 2=blade length) L of the dewatering inhibiting blades 21B to 21F, that is, expressed as l/L.

Further, in the case of discriminating the blade lengths of the dewatering inhibiting blades 21B to 21F, the blade lengths are expressed as $L_1$ to $L_5$, respectively. If not discriminating (when expressing them in a general way), they are expressed as L. Further, in the case of discriminating the contact lengths between the plane sections 23B to 23F of the dewatering inhibiting blades 21B to 21F and the wire 3, the contact lengths are expressed as $l_1$ to $l_5$, and if not discriminating them (when expressing them in a general way), they are expressed as l.

In this case, since the lengths (lengths in the flowing direction of the paper raw material liquid 2) $L_1$ to $L_5$ of the dewatering inhibiting blades 21B to 21F are equally L, if the contact lengths $l_1$ to $l_5$ between the plane sections 23B to 23F of the dewatering inhibiting blades 21B to 21F and the wire 3 are made to become sequentially shorter as a whole in proportion as they are positioned on the further downstream side in the flowing direction of the paper raw material liquid 2, the dimensions l/L of the wedge-shaped spaces 25B to 25F can be made to become sequentially larger as a whole in proportion as they are positioned on the further downstream side in the flowing direction of the paper raw material liquid 2.

Naturally, if the blade lengths $L_1$ to $L_5$ of the dewatering inhibiting blades 21B to 21F are different from each other, the contact lengths $l_1$ to $l_5$ are set so that the dimensions (the rate of the contact lengths l to the blade lengths) l/L of the wedge-shaped spaces 25B to 25F are made to become sequentially larger as a whole in proportion as they are positioned on the further downstream side in the flowing direction of the paper raw material liquid 2.

This structure is for the purpose of increasing the dewatering pressure peak value toward the downstream side in the paper raw material liquid 2 flowing direction. That is, as indicated with a two-dot chain line (θ=30°), a broken line (θ=20°), a solid line (θ=10°) and a dashed line (θ=5°), a characteristic that the dewatering pressure peak value increases as the wedge-shaped spaces 25B to 25F become larger occurs in relation to all the wedge-angles θ.

For this reason, in a manner that the contact lengths $l_1$ to $l_5$ between the plane sections 23B to 23F of the dewatering inhibiting blades 21B to 21F and the wire 3 are made to become sequentially shorter as a whole in proportion as they are positioned on the further downstream side in the flowing direction of the paper raw material liquid 2, that is, in a manner that the dimensions of the wedge-shaped spaces 25B to 25F are separately made to become gradually larger, the dewatering pressure peak value can increase as they are on the further downstream side in the flowing direction of the paper raw material liquid 2.

Since the dewatering instrument for a paper machine twin-wire former according to the second embodiment of this invention is constructed as described above, in the dewatering process, in the second dewatering instrument 6, the dewatering to the top wire 3 side is inhibited by the dewatering inhibiting blades 21B to 21F while the dewatering to only the bottom wire 4 side is done, and the dewatering pressure peak value between the two wires 3, 4 increases toward the downstream owing to the setting of the contact lengths between the plane sections 23B to 23F and the wire 3 (the setting of the dimensions of the wedge-shaped spaces 25B to 25F (see FIG. 3).

On the other hand, in accordance with advancing toward the downstream side of the paper raw material liquid 2 (the downstream side of the wires 3, 4), the concentration of the paper raw material liquid 2 between the wires 3, 4 becomes higher and the raw material liquid is dewatered while advancing to the downstream side in its flowing direction so that the fiber concentration increases, and hence, the shear force becomes larger by the increase in the dewatering pressure peak value to deal with the impairment of the mobility (the easiness of movement of the fibers), with the result that the fiber dispersion performance does not lower irrespective of advancing to the downstream in the flowing direction of the raw material liquid 2, so which permits the dewatering while maintaining the dispersion performance.

In addition, since the dewatering to the top wire 3 side is suppressed by the dewatering inhibiting blades 21A to 21F so that the dewatering is principally done toward the bottom wire 4 side, the movement of the short fibers in the paper raw material liquid 2 to the outer layer sections is reducible, thereby sufficiently maintaining the inter-fiber coupling in the intermediate layer section at the central portion in the paper layer thickness direction to ensure the strength of the formed paper in its thickness directions.

Furthermore, since the dewatering inhibiting blades 21A to 21F are made to be insertable and extractable in their width directions (in the directions of the thickness of the FIG. 1 paper sheet), in a manner that they are replaced with dewatering inhibiting blades with appropriate wedge-shaped spaces, the dewatering quantity distribution or the dewatering ability is easily adjustable in accordance with the kind of paper or the paper-producing conditions. In addition, since the lengths of the dewatering inhibiting blades 21B to 21F are set to be equal to each other, if we prepare dewatering inhibiting blades with various wedge-shaped spaces, which are standardized to equally have a length of L, and appropriately selecting and using them, it is possible to cope with various kinds of paper and paper producing conditions.

Still further, it is also appropriate to make a combination of the first and second embodiments. That is, in addition to the inclination angles (wedge-angles) θ of the inclined surfaces 24B to 24F of the dewatering inhibiting blades 21B to 21F being sequentially set to gradually become smaller as the dewatering inhibiting blades 21B to 21F are on the further downstream side in the flowing direction of the paper raw material liquid 2 (on the downstream side in the wire traveling direction), the dimensions of the wedge-shaped spaces 25B to 25F are made to become larger in accordance with advancing in the flowing direction of the paper raw material liquid 2 (in other words, the contact lengths $l_1$ to $l_5$ between the plane sections 23B to 23F of the dewatering inhibiting blades 21B to 21F and the wire 3 are made to become sequentially shorter in accordance with advancing in the flowing direction of the paper raw material liquid 2.

Thus, the dewatering pressure peak value can be set to increase toward the downstream side in the flowing direction of the paper raw material liquid 2 in relation to the wedge-angles θ and in terms of the wedge-shaped spaces (the contact lengths between the plane sections and the wire), so that the degree of freedom improves for making the fiber dispersion and the thickness-direction strength compatible with each other.

Figure 9:
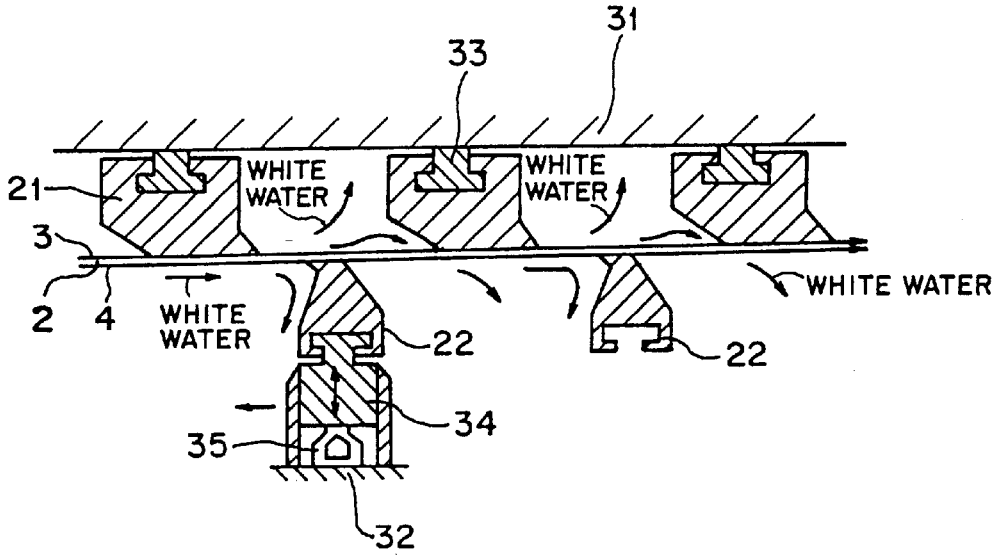
FIG. 9 RELATED ART
FIG. 9 is a structural cross-sectional view showing a modification of the prior dewatering instrument.

Although in the respective embodiments the dewatering inhibiting blades 21A to 21F are disposed continuously, that is, placed not to make a space therebetween, it is also possible that the dewatering inhibiting blades 21A to 21F are disposed intermittently to make a space therebetween (see FIG. 9). Further, in this case, it is also possible that only a portion of the dewatering inhibiting blades 21A to 21F are disposed intermittently.

If the dewatering inhibiting blades 21A to 21F are thus disposed intermittently, the fiber dispersion improves, whereas the thickness-direction strength tends to become weak, and therefore, when attaching importance to the fiber dispersion, the dewatering inhibiting blades 21A to 21F are disposed intermittently. On the other hand, for making the fiber dispersion and the thickness-direction strength compatible with each other, the dewatering inhibiting blades 21A to 21F are disposed not to make a space therebetween.

Furthermore, any setting of the wedge-angles θ or the wedge-shaped spaces (the contact lengths between the plane sections and the wire) is acceptable as long as the dewatering pressure peak value is apt to increase as a whole in accordance with advancing to the downstream side. That is, a limitation is not imposed on the setting made so that all the wedge-angles θ or the wedge-shaped spaces (the contact lengths between the plane sections and the wire) cause the dewatering pressure peak value to become higher on the downstream side than on the upstream side (i.e., $\theta_1>\theta_2>\theta_3>\theta_4>\theta_5$ and $l_1>l_2>l_3>l_4>l_5$).

Although in the second embodiment, paying attention to the dimensions of the wedge-shaped spaces 25B to 25F, the dimensions of the wedge-shaped spaces 25B to 25F are set to become larger in accordance with advancing in the flowing direction of the paper raw material liquid 2, if giving consideration to the contact lengths $l_1$ to $l_5$ between the plane sections 23B to 23F of the dewatering inhibiting blades 21B to 21F and the wire 3, the dewatering pressure peak value increases as the contact lengths become shorter.

Accordingly, even if the contact lengths $l_1$ to $l_5$ between the plane sections 23B to 23F of the dewatering inhibiting blades 21B to 21F and the wire 3 are merely set to become shorter in accordance with advancing in the flowing direction of the paper raw material liquid 2, it is considered that the dewatering pressure peak value tends to increases in accordance with advancing toward the downstream side.

Moreover, the configurations of the inclined surfaces are not particularly limited, and it is also possible to employ, in addition to the plane configurations, concave or convex curved configurations in cross section in the flowing direction or combined configuration thereof.

Besides, the number of dewatering inhibiting blades is not limited to the number shown in the embodiments.

What is claimed is:

1. A dewatering instrument for a paper machine twin-wire former which is equipped with a plurality of dewatering inhibiting blades disposed to face a paper gap between two wires each having a loop configuration and which is made to operate said wires in a state where a paper raw material liquid is introduced into said paper gap of said twin-wire former and dewatered to form a paper, wherein each of said dewatering inhibiting blades has a plane section for supporting said wires and an inclined surface forming a wedge-shaped space spreading out toward an upstream side in a wire traveling direction said wedge-shaped spaces defining a wedge angle between said inclined surface and said wire, wherein each of said dewatering inhibiting blades provides different dewatering peak value from other disposed downstream in the wire traveling direction by respectively forming different shape of wedge-shaped space therein, and wherein said dewatering inhibiting blades, which are arranged in the flowing direction of said paper material liquid, are configured in such a manner that, in any pair of said dewatering inhibiting blades at any position of said paper material liquid, one of said pair, disposed downstream in the wire traveling direction with respect to the other one of said pair, provides a larger dewatering pressure peak value than the other one of said pair.

2. A dewatering instrument for a paper machine twin-wire former as defined in claim 1, wherein said wedge-angles are set to become sequentially smaller as said dewatering inhibiting blades are positioned on a further downstream side in said flowing direction of said paper raw material liquid.

3. A dewatering instrument for a paper machine twin-wire former as defined in claim 2, wherein said plurality of dewatering inhibiting blades are disposed intermittently.

4. A dewatering instrument for a paper machine twin-wire former as defined in claim 2, wherein said plurality of dewatering inhibiting blades are disposed continuously.

5. A dewatering instrument for a paper machine twin-wire former as defined in claim 2, wherein a portion of or all of said plurality of dewatering inhibiting blades are constructed to be insertable or extractable in their width directions.

6. A dewatering instrument for a paper machine twin-wire former as defined in claim 2, wherein said two wires are a top wire and a bottom wire, respectively, and said plurality of dewatering inhibiting blades are placed within said loop of said top wire.

7. A dewatering instrument for a paper machine twin-wire former as defined in claim 1, wherein dimensions of said wedge-shaped spaces defined between said inclined surface and said wire are made to become sequentially larger as said dewatering inhibiting blades are positioned on a further downstream side in said flowing direction of said paper raw material liquid.

8. A dewatering instrument for a paper machine twin-wire former as defined in claim 7, wherein said plurality of dewatering inhibiting blades are disposed intermittently.

9. A dewatering instrument for a paper machine twin-wire former as defined in claim 7, wherein said plurality of dewatering inhibiting blades are disposed continuously.

10. A dewatering instrument for a paper machine twin-wire former as defined in claim 7, wherein a portion of or all of said plurality of dewatering inhibiting blades are constructed to be insertable or extractable in their width directions.

11. A dewatering instrument for a paper machine twin-wire former as defined in claim 7, including top wire and a bottom wire, and said plurality of dewatering inhibiting blades are placed on said top wire.

12. A dewatering instrument for a paper machine twin-wire former as defined in claim 1, wherein said wedge-angles are set to become sequentially smaller as said dewatering inhibiting blades are positioned on a further downstream side in said flowing direction of said paper raw material liquid, and dimensions of said wedge-shaped spaces defined between said inclined surface and said wire are made to become sequentially larger as said dewatering inhibiting blades are positioned on a further downstream side in said flowing direction of said paper raw material liquid.

13. A dewatering instrument for a paper machine twin-wire former as defined in claim 12, wherein said plurality of dewatering inhibiting blades are disposed intermittently.

14. A dewatering instrument for a paper machine twin-wire former as defined in claim 12, wherein said plurality of dewatering inhibiting blades are disposed continuously.

15. A dewatering instrument for a paper machine twin-wire former as defined in claim 12, wherein a portion of or all of said plurality of dewatering inhibiting blades are constructed to be insertable of extractable in their width directions.

16. A dewatering instrument for a paper machine twin-wire former as defined in claim 12, including top wire and a bottom wire, and said plurality of dewatering inhibiting blades are placed on said top wire.

17. A dewatering instrument for a paper machine twin-wire former as defined in claim 1, wherein said plurality of dewatering inhibiting blades are disposed intermittently.

18. A dewatering instrument for a paper machine twin-wire former as defined in claim 1, wherein said plurality of dewatering inhibiting blades are disposed continuously.

19. A dewatering instrument for a paper machine twin-wire former as defined in claim 1, wherein a portion of or all of said plurality of dewatering inhibiting blades are constructed to be insertable of extractable in their width directions.

20. A dewatering instrument for a paper machine twin-wire former as defined in claim 1, wherein said two wires are a top wire and a bottom wire, respectively, and said plurality of dewatering, inhibiting blades are placed within said loop of said top wire.

21. A dewatering instrument for a paper machine twin-wire former as defined in claim 1, wherein said dewatering inhibiting blade is disposed against only one of two wires.

22. A dewatering instrument for a paper machine twin-wire former as defined in claim 1, wherein angles of the wedge-shaped spaces are set in such manner that in said arbitrary pair, said downstream dewatering inhibiting blade has a smaller angle than said upstream dewatering inhibiting blade.

23. A dewatering instrument for a paper machine twin-wire former as defined in claim 1, wherein dimensions of the wedge-shaped spaces are set in such manner that, in said arbitrary pair of said dewatering inhibiting blades, said downstream dewatering inhibiting blade has a larger dimension than an upstream dewatering inhibiting blade.

24. A dewatering instrument for a paper machine twin-wire former as defined in claim 1, wherein angles and dimensions of the wedge-shaped spaces are set in such manner that, in said arbitrary pair of said dewatering inhibiting blades, said downstream dewatering inhibiting blade has a smaller angle and a larger dimension that said upstream dewatering inhibiting blade.

* * * * *